United States Patent [19]

Grimes et al.

[11] Patent Number: 4,582,544

[45] Date of Patent: Apr. 15, 1986

[54] PRODUCTION OF METALLIC ARTICLES

[75] Inventors: Roger Grimes; William S. Miller, both of Gerrards Cross, England

[73] Assignee: Alcan International Limited, Montreal, Canada

[21] Appl. No.: 595,445

[22] Filed: Mar. 30, 1984

[30] Foreign Application Priority Data

Mar. 31, 1983 [GB] United Kingdom ..... 8308906

[51] Int. Cl.[4] ..... C22F 1/04

[52] U.S. Cl. ..... 148/11.5 A; 148/439; 420/902

[58] Field of Search ..... 148/11.5 A, 2, 439; 420/902

[56] References Cited

FOREIGN PATENT DOCUMENTS 1387586 3/1975 United Kingdom .
1445181 8/1976 United Kingdom .
1456050 11/1976 United Kingdom .

OTHER PUBLICATIONS

C. Howard Hamilton, Cliff C. Bampton and Neil E. Paton, "Superplasticity in High Strength Aluminum Alloys", Rockwell International Science Center.

*Primary Examiner*—R. Dean
*Attorney, Agent, or Firm*—Karl W. Flocks; Sheridan Neimark

[57] ABSTRACT

A method of superplastically deforming a blank of a metallic alloy which:

1. has a composition suitable for superplastic deformation and
2. has a grain structure suitable for superplastic deformation and
3. contains less than that percentage of a constituent known to inhibit grain coarsening after recrystallization which is necessary for such inhibition, comprising raising the blank to a forming temperature, deforming the blank at a first strain rate to induce dynamic recrystallization and continuing to deform the blank at a second strain rate lower than the first rate.

13 Claims, 2 Drawing Figures

STRAINED AT 12.5 mm/min

STRAINED AT 12·5 mm/min

STRAINED AT 3·38 mm/min

PRODUCTION OF METALLIC ARTICLES

Figure 1A:
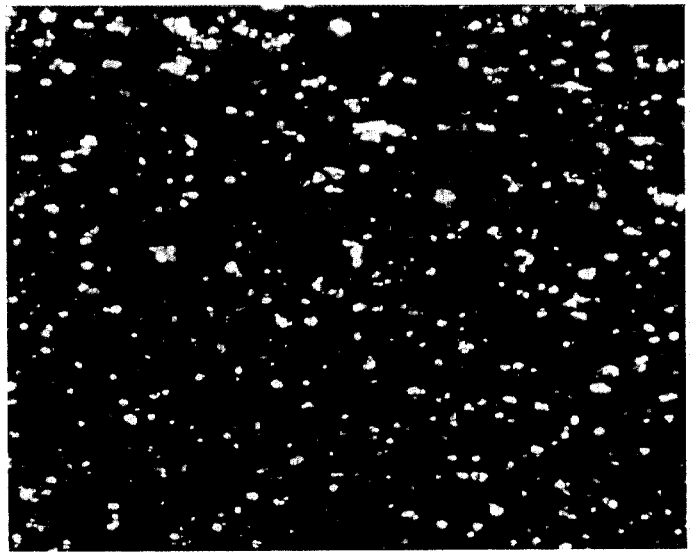
Figure 1B:
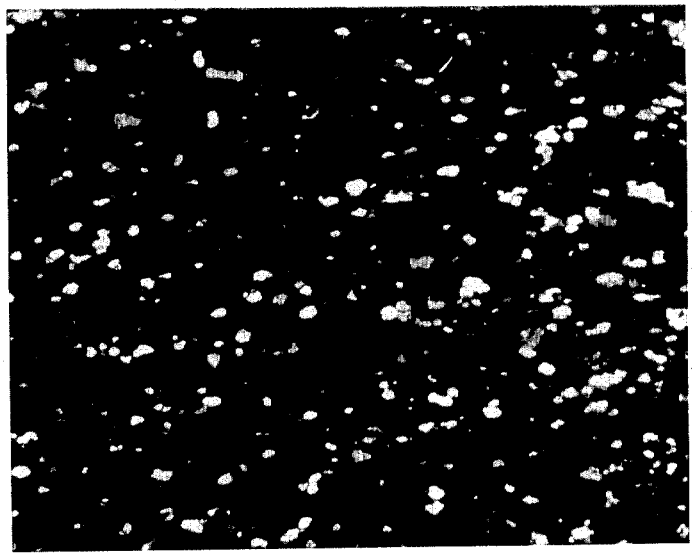

This invention relates to the production of metallic articles by superplastic deformation.

Earlier work on superplastically deformable aluminium alloys has been concentrated in four main areas as follows:

(1) Eutectic (or eutectoid) compositions more recently exemplified by Al/Ca alloys.

(2) Compositions in which only small volume fractions of second phase particles are present at ambient temperatures and even smaller volume fractions at the temperatures of superplastic deformation. The superplastic performance of these alloys is critically dependent upon the correct dispersion of very fine particles such as $ZrAl_3$. Such alloys are disclosed in our U.K. Pat. Nos. 1387586 and 1445181.

(3) Varying the thermo-mechanical processing of "standard" aluminium aircraft alloys such as 7075 and 7475 to achieve a very fine grain size prior to superplastic deformation. Such work, notably by Rockwell International, is referred to in C H Hamilton, C C Bampton and N E Paton "SUperplasticity in High Strength Aluminium Alloys", pp 173–189 in *Superplastic Forming of Structural Alloys* edited by N E Paton and C H Hamilton eds, AIME, New York, NY, 1982. (ISBN 0-89520-389-8).

(4) Alloys such as 2004 and its derivatives having a composition suitable for superplastic deformation but a grain structure which precludes it; the grain structure being modified by an initial non-superplastic deformation step at a suitable forming temperature to induce dynamic strain recrystallisation so that a fine recrystallised grain structure is progressively developed and superplastic deformation can then take place.

Our U.K. Pat. No. 1456050 discloses the method of paragraph No. 4 above.

Numerous aluminium alloys are disclosed in specification No. 1456050 and common to all of them is the inclusion of a constituent (Zr, Nb, Ta or Ni) to inhibit grain coarsening after recrystallisation. Such grain coarsening inhibitor had previously been found to be essential. In addition specification No. 1456050 shows that, with the alloys discussed therein, dynamic strain recrystallisation does not occur if the rate of forming is too fast.

We have now found that certain aluminium alloys which do not include a constituent to act as a grain coarsening inhibitor (or which include less of such substance than would be necessary for it to act as a grain coarsening inhibitor) may readily be superplastically deformed by modifying the customary deforming process.

According therefore to its broadest aspect the present invention provides a method of superplastically deforming a blank of a metallic alloy which:

A. has a composition suitable for superplastic deformation and

B. has a grain structure suitable for superplastic deformation and

C. contains less than that percentage of a constituent known to inhibit grain coarsening after recrystallisation which is necessary for such inhibition, comprising raising the blank to a forming temperature, deforming the blank at a first strain rate to induce dynamic recrystallisation and continuing to deform the blank at a second strain rate lower than the first rate.

Alloys suitable for the performance of this method include conventionally processed aluminium alloys 7075 and 7475 (United States Aluminum Association specifications). Preferably however the method is applied to Al/Li alloys and, in particular, to such alloys as disclosed in our copending application No. 8308908 filed on Mar. 31, 1983.

The above and other aspects of the present invention will now be described by way of example with reference to the single FIGURE of the accompanying drawing which shows micrographs (a) and (b)

EXAMPLE

Alloy composition

Lithium: 2.62
Magnesium: 0.68
Copper: 1.21
Zirconium: 0.12
Titanium: 0.01
Aluminium: Remainder (including incidental impurities)

The alloy was cast as a 300 kg rolling ingot 508 mm×178 mm in section, homogenised and scalped to removed surface imperfections. The ingot was preheated to 530° C. and hot rolled to 5 mm hot blank. The 5 mm hot blank was cold rolled to produce 1.6 mm gauge sheet.

Two samples of the sheet were superplastically deformed after preheating to 510° C. for 20 mins. At a cross head velocity (related to strain rate) of 12.5 mm/min a superplastic elongation of 550% was obtained in one sample whereas at a cross head velocity of 3.38 mm/min a superplastic elongation of 730% was obtained in the other sample. The photomicrograph shows the grain structure of material strained to such a degree that dynamic recrystallisation to a fine grain size had completely replaced the initial wrought structure. The much finer grain size formed during dynamic recrystallisation of material strained at the faster cross head velocity of 12.5 mm/min is evident.

Further samples of the sheet material were preheated to 510° C. for 20 mins. and superplastically deformed at a cross head velocity of 12.5 mm/min until the material had dynamically recrystallised to a structure similar to that shown in (a) of the drawing (in this instance after 200% elongation). The material was further strained at a cross head velocity of 3.38 mm/min and a superplastic elongation of 1185% was obtained. This superplastic ductility was significantly higher than those noted in the previous paragraph for material strained at a single strain rate.

It was also noted that the degree of cavitation was significantly less, at high elongation in material strained at the two different rates as a consequence of the finer grain size of the material.

It is believed that the presence of lithium as well as making a major contribution to the physical and mechanical properties of the alloys also encourages dynamic recrystallisation. However the Al/Li alloys now being considered differ from those of paragraph 4 above in that in their cold worked form they are inherently superplastically deformable and they do not contain enough Zr for the latter to act as a grain coarsening inhibitor after recrystallisation. The two stage deforming process of the present invention is also contrary to our experience as disclosed in UK Pat. No. 1456050 where using too high a strain rate inhibits recrystallisation.

We have found that the first, higher, cross head velocity can vary between 8 and 40 mm/min (representing, for example, strain rates of $1\times10^{-2}$/sec to $5\times10^{-2}$/sec) and the second, lower cross head velocity can vary between 0.75 and 3.75 mm/min (representing, for example, strain rates of $1\times10^{-3}$/sec to $5\times10^{-3}$/sec). In a practical bi-axial forming operation the higher strain rate may be applied for a time varying between 60 and 180 seconds and the lower strain rate may be applied for a time varying between 20 and 30 minutes.

As disclosed in our copending UK Application No. 8308908 aluminium base alloys having a composition within the following ranges in weight percent are particularly suitable for the method of the present invention.

Lithium: 2.3 to 2.9
Magnesium: 0.5 to 1.0
Copper: 1.6 to 2.4
Zirconium: 0.05 to 0.25
Titanium: 0 to 0.5
Manganese: 0 to 0.5
Nickel: 0 to 0.5
Chromium: 0 to 0.5
Zinc: 0 to 2.0
Aluminium: Remainder (apart from incidental impurities)

It is believed that the unexpected results achieved by the two-stage process of the present invention may be related to the facility which some alloys exhibit to recrystallise dynamically offset by the tendency for some of the recrystallised grains to coarsen. Particularly in the case of the lithium containing alloys, the rapid initial straining ensures that a uniform finer grain structure is obtained. In contrast when a single, slower, strain rate is used some coarser grains result so that during continued deformation these coarser grains give rise to premature failure.

We claim:

1. A method of superplastically deforming a blank of a metallic alloy which:

A. has a composition suitable for superplastic deformation and

B. has a grain structure suitable for superplastic deformation and

C. contains less than that percentage of a constituent known to inhibit grain coarsening after recrystallisation which is necessary for such inhibition, comprising raising the blank to a forming temperature, deforming the blank at a first strain rate to induce dynamic recrystallisation and continuing to deform the blank at a second strain rate lower than the first rate.

2. A method according to claim 1 in which the first strain rate is between $1\times10^{-2}$/sec and $5\times10^{-2}$/sec and the second strain rate is between $1\times10^{-3}$/sec and $5\times10^{-3}$/sec.

3. A method according to claim 1 in which the first strain rate is at a velocity of 8 to 40 mm/min and the second strain rate is at a velocity of 0.75 to 3.75 mm/min.

4. A method according to claim 3 in which the first strain rate is at a velocity of approximately 12.5 mm/min and the second strain rate is at a velocity of approximately 3.38 mm/min.

5. A method according to claim 1 in which the first strain rate is applied for a time between 60 and 180 seconds and the second strain rate is applied for a time between 20 and 30 minutes.

6. A blank of an aluminium base alloy, deformed according to the method of claim 1, and selected from the following:

A. 7075 or

B. 7475 or

C. a composition within the following ranges in weight percent:

Lithium: 2.3 to 2.9
Magnesium: 0.5 to 1.0
Copper: 1.6 to 2.4
Zirconium: 0.05 to 0.25
Titanium: 0 to 0.5
Manganese: 0 to 0.5
Nickel: 0 to 0.5
Chromium: 0 to 0.5
Zinc: 0 to 2.0
Aluminium: Remainder (apart from incidental impurities).

7. A method according to claim 2 in which the first strain rate is at a velocity of 8 to 40 mm/min and the second strain rate is at a velocity of 0.75 to 3.75 mm/min.

8. A method according to claim 7 in which the first strain rate is at a velocity of approximately 12.5 mm/min and the second strain rate is at a velocity of approximately 3.38 mm/min.

9. A method according to claim 2 in which the first strain rate is applied for a time between 60 and 180 seconds and the second strain rate is applied for a time between 20 and 30 minutes.

10. A method according to claim 3 in which the first strain rate is applied for a time between 60 and 180 seconds and the second strain rate is applied for a time between 20 and 30 minutes.

11. A method according to claim 4 in which the first strain rate is applied for a time between 60 and 180 seconds and the second strain rate is applied for a time between 20 and 30 minutes.

12. A method according to claim 7 in which the first strain rate is applied for a time between 60 and 180 seconds and the second strain rate is applied for a time between 20 and 30 minutes.

13. A method according to claim 8 in which the first strain rate is applied for a time between 60 and 180 seconds and the second strain rate is applied for a time between 20 and 30 minutes.

* * * * *